US006110003A

United States Patent [19]

Green

[11] Patent Number: 6,110,003

[45] Date of Patent: Aug. 29, 2000

[54] RADIO CONTROL TRANSPORT HAULER

[76] Inventor: Robert W. Green, 1432 N. Emerald Dr., Layton, Utah 84040

[21] Appl. No.: 09/220,917

[22] Filed: Dec. 24, 1998

[51] Int. Cl.[7] ..... A63H 17/06

[52] U.S. Cl. ..... 446/428; 446/427; 446/434; 446/435

[58] Field of Search ..... 446/427, 428, 446/434, 435, 465, 470, 471; 414/915, 537; 298/1 T, 17 R; 280/475, 511, 512

[56] References Cited

U.S. PATENT DOCUMENTS 766,518 8/1904 Pay ..... 298/17 R
1,538,052 5/1925 Mueller ..... 298/17 R
1,659,245 2/1928 Delker ..... 298/17 R
2,408,862 10/1946 Lisota ..... 414/483
2,609,212 9/1952 McMurtrie ..... 280/495
3,731,974 5/1973 Stafford ..... 298/17 R
4,872,728 10/1989 Adams ..... 298/5

*Primary Examiner*—Sam Rimell
*Assistant Examiner*—Bena B. Miller

[57] ABSTRACT

A trailer is provided including a neck adapted for engaging a towing structure. A frame is fixedly attached to the neck. A plurality of wheel assemblies are coupled to the frame. Also included is a deck pivotally attached to the frame.

6 Claims, 2 Drawing Sheets

RADIO CONTROL TRANSPORT HAULER

BACKGROUND OF THE INVENTION

1. Field of the Invention

The present invention relates to toy trailers and more particularly pertains to a new radio control transport hauler for the transportiong of one radio controlled vehicle by another.

2. Description of the Prior Art

The use of toy trailers is known in the prior art. More specifically, toy trailers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,232,393; U.S. Pat. No. Des. 323,685; U.S. Pat. No. Des. 298,765; U.S. Pat. No. Des. 296,346; U.S. Pat. No. Des. 296,346; and U.S. Pat. No. 2,590,388.

In these respects, the radio control transport hauler according to the present invention substantially departs from the conventional concepts and designs of the prior art, and in so doing provides an apparatus primarily developed for the purpose of transporting of one radio controlled vehicle by another.

SUMMARY OF THE INVENTION

In view of the foregoing disadvantages inherent in the known types of toy trailers now present in the prior art, the present invention provides a new radio control transport hauler construction wherein the same can be utilized for transporting of one radio controlled vehicle by another.

The general purpose of the present invention, which will be described subsequently in greater detail, is to provide a new radio control transport hauler apparatus and method which has many of the advantages of the toy trailer mentioned heretofore and many novel features that result in a new radio control transport hauler which is not anticipated, rendered obvious, suggested, or even implied by any of the prior art toy trailer, either alone or in any combination thereof.

To attain this, the present invention generally comprises a neck having a stand member, a hitch portion, and a span member. The span member has a first end and a second end. The stand member has a mounted end and a free end. The mounted end is pivotally attached to the first end of the span member. The free end is for engaging a stationary surface. The hitch portion is attached to the second end of the span member. The hitch portion comprises a peripheral wall forming a semi-spherical cavity therein. The peripheral wall has a plurality of vertical slots extending through the peripheral wall to the cavity for affording a resilient hitch portion for snappily engaging a ball hitch of a vehicle. Next provided is a frame having an angled portion and a base portion. The angled portion has two triangular cutouts to form a central flange and a pair of exterior flanges. The outer flanges are symmetrical about the central flange. The central flange is aligned with a longitudinal axis of the base portion. The base portion has a flat rectangular upper surface and a lower surface. The angled portion is downwardly angled from the first end of the span member to orient the base portion at a lower plane with respect to the neck. Also included is a pair of wheel assemblies each having a first wheel, a second wheel, an axle, and a holding member. Each of the wheel assemblies has the axle rotatably suspended through the holding member. The first wheel is fixedly attached to an end of the axle. The second wheel is fixedly attached to the axle opposite the first wheel. The holding member is integrally attached to the lower surface of the base portion. A deck has a planar rectangular top surface and a bottom surface. The deck is pivotally attached to the frame. It should be noted that the action of raising and lower the deck may be accomplished through any number of actuating means. The bottom surface has a plurality of ribs being aligned perpendicular to a longitudinal axis of the deck and being equally spaced along the bottom surface. In use, the deck has a length greater than a length of the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new radio control transport hauler apparatus and method which has many of the advantages of the toy trailers mentioned heretofore and many novel features that result in a new radio control transport hauler which is not anticipated, rendered obvious, suggested, or even implied by any of the prior art toy trailers, either alone or in any combination thereof.

It is another object of the present invention to provide a new radio control transport hauler which may be easily and efficiently manufactured and marketed.

It is a further object of the present invention to provide a new radio control transport hauler which is of a durable and reliable construction.

An even further object of the present invention is to provide a new radio control transport hauler which is susceptible of a low cost of manufacture with regard to both materials and labor, and which accordingly is then susceptible of low prices of sale to the consuming public, thereby making such radio control transport hauler economically available to the buying public.

Still yet another object of the present invention is to provide a new radio control transport hauler which provides in the apparatuses and methods of the prior art some of the advantages thereof, while simultaneously overcoming some of the disadvantages normally associated therewith.

Still another object of the present invention is to provide a new radio control transport hauler for the transportiong of one radio controlled vehicle by another.

Still yet another object of the present invention is to provide a new radio control transport hauler that includes a neck adapted for engaging a towing structure. A frame fixedly attached to the to the neck. A plurality of wheel assemblies are coupled to the base portion. Also included is a deck pivotally attached to the frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
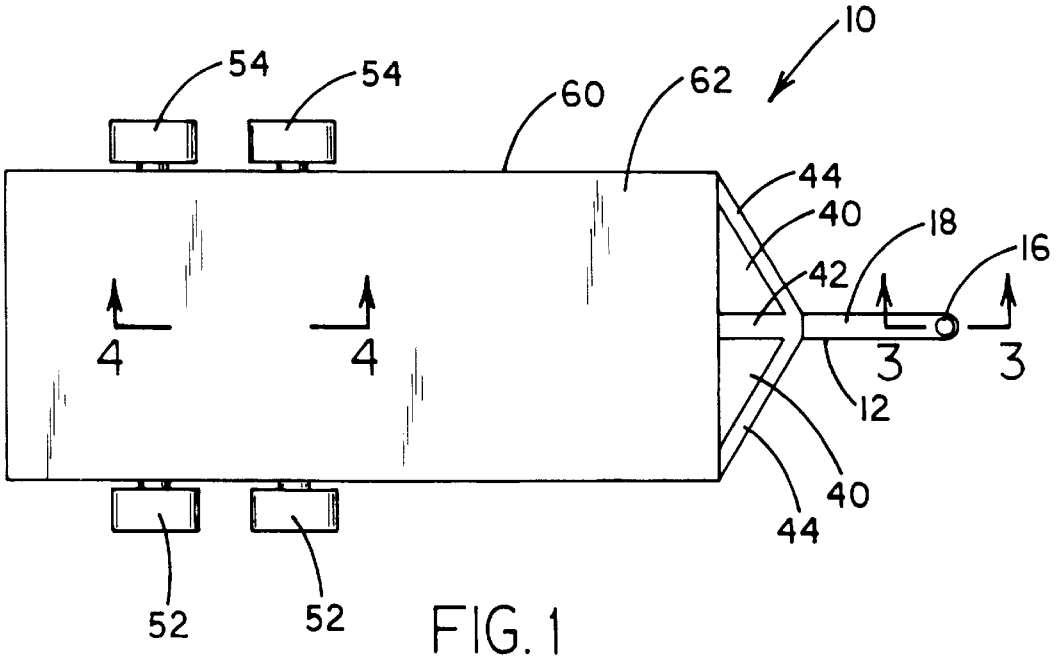
FIG. 1 is a top plan view of a new radio control transport hauler according to the present invention.
Figure 2:
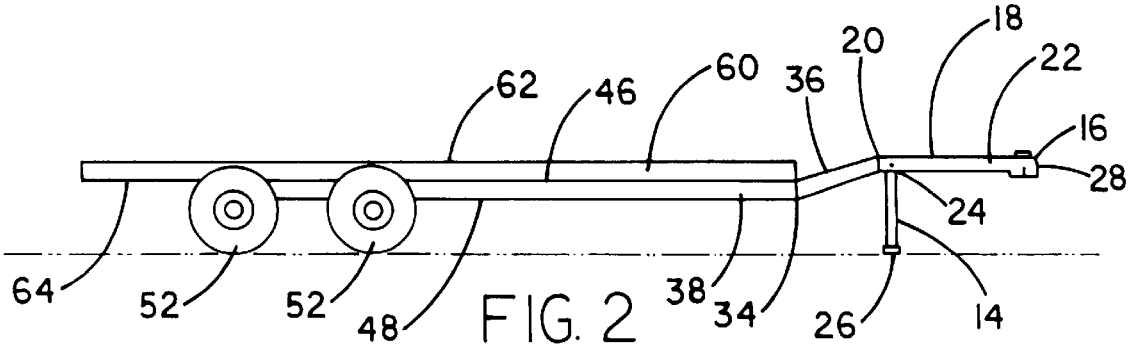
FIG. 2 is a left side elevational view of the present invention.
Figure 3:
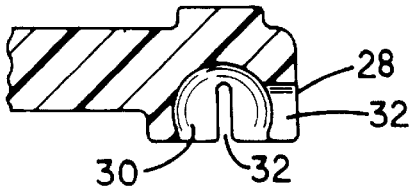
FIG. 3 is a cross-sectional view of the present invention taken along line 3—3 as shown in FIG. 1.
Figure 4:
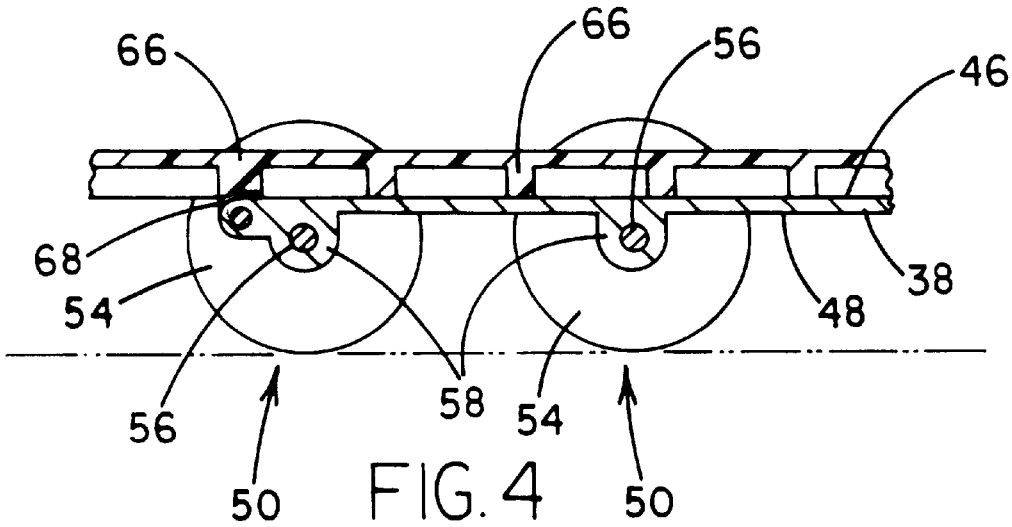
FIG. 4 is a cross-sectional view of the present invention taken along line 4—4 as shown in FIG. 1.
Figure 5:
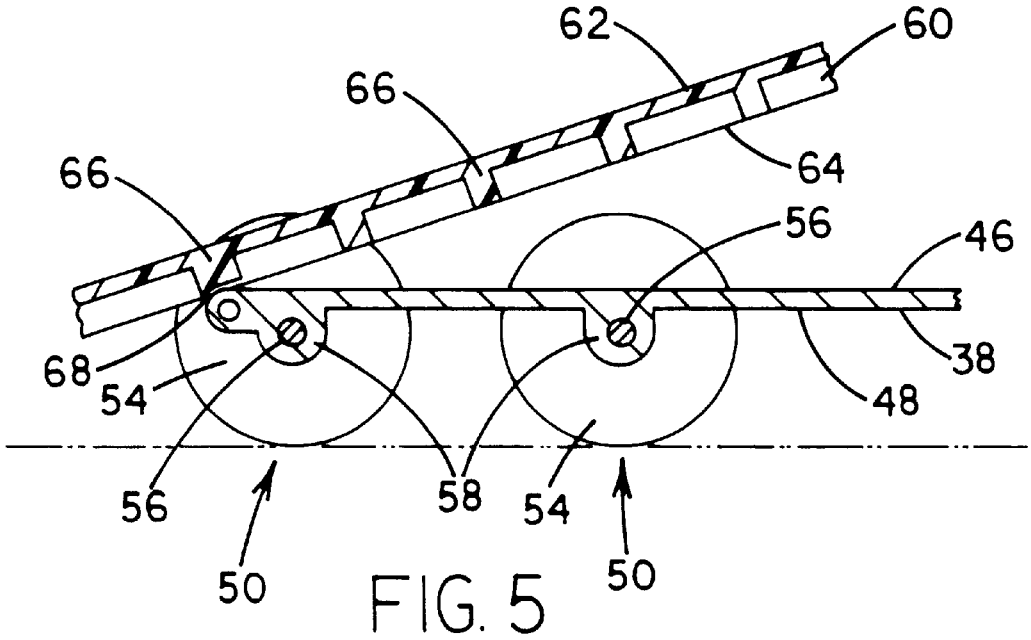
FIG. 5 is a cross-sectional view of the present invention as shown in FIG. 4 with the deck in an alternate position.

With reference now to the drawings, and in particular to FIGS. 1 through 5 thereof, a new radio control transport hauler embodying the principles and concepts of the present invention and generally designated by the reference numeral 10 will be described.

The present invention, designated as numeral 10, generally comprises a neck 12 having a stand member 14, a hitch portion 16, and a span member 18. The span member has a first end 20 and a second end 22. The stand member has a mounted end 24 and a free end 26. The mounted end is pivotally attached to the first end of the span member. The free end is for engaging a stationary surface. The hitch portion is attached to the second end of the span member. The hitch portion comprises a peripheral wall 28 forming a semi-spherical cavity 30 therein. The peripheral wall has a plurality of vertical slots 32 extending perpendicularly through the peripheral wall to the cavity for affording a resilient hitch portion for being snappily engaging a ball hitch of a vehicle.

Next provided is a frame 34 having an angled portion 36 and a base portion 38. The angled portion has two triangular cutouts 40 to form a central flange 42 and a pair of exterior flanges 44. The outer flanges are symmetrical about the central flange. The central flange is aligned with a longitudinal axis of the base portion. The base portion has a flat rectangular upper surface 46 and a lower surface 48. The angled portion is downwardly angled from the first end of the span member to orient the base portion at a lower plane with respect to the neck.

Also included is a pair of wheel assemblies 50 each having a first wheel 52, a second wheel 54, an axle 56, and a holding member 58. Each of the wheel assemblies has the axle rotatably suspended through the holding member. The first wheel is fixedly attached to an end of the axle. The second wheel is fixedly attached to the axle opposite the first wheel. The holding member is integrally attached to the lower surface of the base portion. The wheels are preferably constructed from a wooden material A deck 60 has a planar rectangular top surface 62 and a bottom surface 64. The deck is pivotally coupled to the frame directly behind the rear set of wheels and along the rear edge of the frame. The desk is pivoted for reducing stress on the connection on between the neck and a towing structural. It should be noted that the action of raising and lowering the deck may be accomplished through any number of manual or automatic actuating means which may be triggered through directed contact or from a remote location via radio control. The bottom surface has a plurality of ribs 66 being aligned perpendicular to a longitudinal axis of the deck and being equally spaced along the bottom surface. A plurality of tabs 68 project downward from one of the ribs. The tabs are adapted for engaging a plurality of cutouts of the frame for allowing a rigid rod to be inserted through bores in the tabs and cutouts to allow for the deck to pivot in relation to the frame. The deck has a ratio of 1.2 per unit length of the base portion. The preferred dimensions of article are a height of five inches or less, a width of twelve inches or less and a length of no greater than twenty-four inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy flatbed trailer system comprising, in combination:

a neck having a stand member, a hitch portion, and a span member, the span member having a first end and a second end, the stand member having a mounted end and a free end, the mounted end pivotally attached to the first end of the span member, the free end being adapted for engaging a stationary surface, the hitch portion attached to the second end of the span member, the hitch portion comprising a peripheral wall forming a semi-spherical cavity therein, the peripheral wall having a plurality of slots extending perpendicularly through the peripheral wall to the cavity;

a frame having an angled portion and a base portion, the angled portion having two triangular cutouts to form a central flange and a pair of exterior flanges, the exterior flanges being symmetrical about the central flange, the central flange being aligned with a longitudinal axis of the base portion, the base portion having a flat rectangular upper surface and a lower surface, wherein the angled portion being downwardly angled from the first end of the span member to orient the base portion at a lower plane than the neck;

a pair of wheel assemblies each having a first wheel, a second wheel, an axle, and a holding member, each of the wheel assemblies having the axle rotatably suspended through the holding member, the first wheel fixedly attached to an end of the axle, the second wheel fixedly attached to the axle opposite the first wheel, the holding member being fixedly attached to the lower surface of the base portion such that the wheel assemblies have a length therebetween for preventing the base portion from tipping when turning abruptly;

a deck having a planar rectangular top surface and a bottom surface, the deck being pivotally attached to the frame, the bottom surface having a plurality of ribs being aligned perpendicular to a longitudinal axis of the deck and being equally spaced along the bottom surface, wherein the deck having a length greater than a length of the frame; and wherein the deck is pivotally attached to the frame at a pivot connection located at an end of the frame opposite the neck such that the wheel assemblies are positioned between the pivot connection and the neck, the frame being kept in a horizontal orientation when the deck is pivoted for reducing stress on the connection between the neck and a towing structure.

2. A toy trailer comprising:

a neck adapted for engaging a towing structure;

a frame fixedly attached to the neck;

a plurality of wheel assemblies coupled to the frame, the plurality of wheel assemblies arranged in tandem to each other for preventing the frame from tipping when turned abruptly; and a deck pivotally attached to the frame, wherein the deck is pivotally attached to the frame at a pivot connection located at an end of the frame opposite the neck such that the wheel assemblies are positioned between the pivot connection and the neck, the frame being kept in a horizontal orientation when the deck is pivoted for reducing stress on the connection between the neck and the towing structure.

3. A toy trailer as set forth in claim 2 wherein the neck includes a hitch portion.

4. A toy trailer as set forth in claim 3 wherein the hitch portion includes a semi-spherical cavity.

5. A toy trailer as set forth in claim 2 wherein the deck is positioned parallel to the frame.

6. A toy trailer as set forth in claim 2 wherein the deck further includes a plurality of ribs being aligned perpendicular to a longitudinal axis of the deck.

* * * * *